United States Patent [19]

Hochberg

[11] Patent Number: 4,690,279

[45] Date of Patent: Sep. 1, 1987

[54] BIRTH CONTROL PILL DISPENSER IN THE FORM OF A HAIR BRUSH

[76] Inventor: Charles Hochberg, 508 Jeffords St., Clearwater, Fla. 33516

[21] Appl. No.: 839,202

[22] Filed: Mar. 13, 1986

[51] Int. Cl.[4] ..... B65D 83/04

[52] U.S. Cl. ..... 206/531; 15/106; 132/148; 206/457; 206/538; 221/25; 221/97; 221/199; 401/268

[58] Field of Search ..... 206/528–540, 206/457; 401/268; 132/84 R, 84 A, 84 B, 148; 15/106; 221/5, 97, 25, 199, 95, 100

[56] References Cited

U.S. PATENT DOCUMENTS

| | | | |
|---|---|---|---|
| 1,364,188 | 1/1921 | Draenert | 401/268 |
| 2,815,032 | 12/1957 | Rosenfeld | 132/148 |
| 3,276,573 | 10/1966 | Kaufman et al. | 206/531 |
| 3,302,775 | 2/1967 | Finkleston, Jr. et al. | 221/97 |
| 3,324,996 | 6/1967 | Jordt | 206/531 |
| 4,074,806 | 2/1978 | Ardito | 206/531 |
| 4,140,140 | 2/1979 | Proia et al. | 132/84 B |
| 4,165,709 | 8/1979 | Studer | 206/531 X |
| 4,169,531 | 10/1979 | Wood | 206/531 |

FOREIGN PATENT DOCUMENTS

| | | | |
|---|---|---|---|
| 795644 | 10/1968 | Canada | 206/540 |
| 2396697 | 3/1979 | France | 206/540 |

*Primary Examiner*—Stephen Marcus
*Assistant Examiner*—B. Gehman
*Attorney, Agent, or Firm*—Ronald E. Smith

[57] ABSTRACT

A package for oral contraceptives that has the outward appearance of a hair brush. A first compartment serves as a pill storage compartment; it retains a three week supply of pills of the type that are individually packaged under a flexible bubble and collectively mounted on a frangible support surface. The floor of the first compartment is apertured and each aperture is pill-sized and positioned in registration with a pill under a bubble. A closure member such as a hinged lid masks the presence of the pill-storage compartment, but when the lid is open and a bubble is pressed against, the frangible support surface for the pill breaks and allows the pill to fall into a second compartment with an imperforate bottom. The second compartment is enclosed on three sides but open on a fourth so that a pill driven through its frangible support surface may be retrieved from such second compartment by tilting the brush.

6 Claims, 5 Drawing Figures

BIRTH CONTROL PILL DISPENSER IN THE FORM OF A HAIR BRUSH

BACKGROUND OF THE INVENTION

1. Field of the Invention

This invention generally relates to birth control pill dispensers and more particularly relates to a device that provides such a dispenser in the form of a hair brush.

2. Description of the Prior Art

It is well known that birth control pills of the type intended to be taken orally by females must be taken daily and in the proper dosage if they are to be effective.

For this reason, the manufacturers of such pills typically provide packaging for the same that is designed to remind the individual taking the medication to do so on a daily basis.

Three pill dispensers are in widespread use. Ortho, Inc. makes a dispenser known as Dialpak; it contains a three week supply of pills arranged in a circle. A dial member at the center of the circle points to a day of the week so that when a pill is removed from the dispenser, the dial can be rotated so that it points to the next day of the week. This design is intended to avoid the inadvertent taking of two pills in one day and is also designed to let the owner of the device know when a day has been skipped.

Mead Johnson & Co. makes a dispenser with an apertured bottom wall; each aperture is the size of a pill and a three week supply of pills is contained within the dispenser; each pill is positioned in a bubble package with a frangible bottom and each package is in registration with an aperture formed in the dispenser's bottom wall. Accordingly, a pill is dispensed by pressing downwardly on the bubble since such pressure breaks the frangible bottom and permits exit of the pill through its associated bottom wall aperture.

A third type of dispenser is manufactured by Wyeth Laboratories; it is constructed similar to the Mead Johnson & Co. dispenser in that it also provides the pills in a bubble which when pressed allows a pill to exit through a frangible bottom wall that supports the pill prior to its rupture. It adds a pill-discharging chamber, however, which is positioned beneath the frangible bottom wall so that the pill is dischrged into the chamber instead of the environment external to the dispenser. One side of the chamber is open to the external environment so that a pill released from its bubble may be removed from the chamber by simply tilting the dispenser so that the pill slides out.

Each of the three dispensers have utilitiy but they share several drawbacks. One shortcoming is that the packages have been so widely marketed that they are easily recognized as being containers for oral contraceptives; persons desiring to maintain a degree of privacy concerning their use of the same cannot do so in view of the well-known packaging. If such an individual spills the contents of her purse in public, for example, all observing the event are immediately apprised of the purse owner's use of the contraceptives.

A more serious drawback of the packages of the prior art is the passivity of their package designs, i.e., the packages are easily forgotton since they are generally stored in purses the contents of which may not be inspected every day or even thought of on a daily basis.

For example, occasions may arise where the owner of a purse containing the pills does not have the purse in her possession. In such situations, the daily pill may not be taken and an unwanted pregnancy may result.

There is a need, therefore, for a dispenser that would not embarrass its owner when displayed, that would remind its owner of its existence on a daily basis so that the daily dosage would not be forgotten, and that would be likely to be in the possession of the user even when the user's purse is not in her possession.

The dispensers now in use do not fill these needs, nor do the constructions of such devices suggest how an improved pill dispenser that meets consumer's needs could be provided.

SUMMARY OF THE INVENTION

The invention provides a pill dispensing device in the form of a hair brush in order to overcome the limitations of the packaging of the prior art.

A hair brush is used daily by those consumers who take oral contraceptives; the use of the brush is usually in the morning at the same time each day.

Accordingly, consumers do not require reminders to use their hair brush each day. If a pill dispenser could be provided in the form of a hair brush, its owner would be reminded at each brushing session that another pill should be consumed.

Preferably, the hair brush would be constructed to provide an audible signal when the brush was used that would further remind the owner to take a pill.

The present invention overcomes the limitations of earlier pill dispensing devices by providing a hair brush with a pair of compartments added to a conventional hair brush; the first compartment surmounts the base of the brush that holds the brush's bristles in place and the second compartment surmounts the first.

More specifically, the first compartment is a pill-discharge compartment the floor of which is the base of the brush which holds the bristles in place. This compartment has three upstanding side walls and an opening through which pills may pass when the brush is tilted. The top wal of the pill-discharge compartment has a plurality of apertures formed therein, each aperture being pill-sized and being positioned in registration with individual pills that are positioned above said apertured top wall in a pill storage compartment.

The pill storage compartment retains a sheet of pills each of which is covered with a flexible bubble individual to each pill and each of which is supported by a frangible support member which breaks in response to pressure exerted on the bubble. A pill breaking through the support member passes through an aperture formed in said pill-discharge compartment top wall and enters into the pill-discharge compartment from which it is thereafter removed when such compartment is tilted.

Thus, it will be noted that the novel construction is similar in some respects tot he Wyeth Laboratories dispenser; both the novel dispenser and the Wyeth dispenser include a pill storage compartment or chamber that surmounts and is separated from a pill dispensing chamber by a wall having pill-sized apertures through which a pill may pass in response to pressing of a bubble and concomitant rupture of a frangible support member.

However, unlike the Wyeth construction, the present invention has none of the appearance characteristics of the Wyeth construction or other oral contraceptive dispensers. More importantly, unlike the Wyeth and other packages of the prior art, the present package design inherently reminds its owner of its function as it quickly becomes associated in the mind of its user as a combination brush and pill dispenser.

The construction also provides an audible reminder of its dual function because the individually packaged pills rattle when the brush is used and even when the brush is simply picked up. The rattling sound serves as a reminder but if it is heard by others, they will make no association of the rattling sound and the presence of hidden contraceptive pills.

The primary object of this invention is to provide a dispenser for oral contraceptives that will remind its owner of the need for daily administration of its contents.

Another object of this invention is to accomplish the foregoing object by providing a hair brush construction having a pill storage chamber and a pill dispensing chamber in addition to its parts that relate to the hair brushing function.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
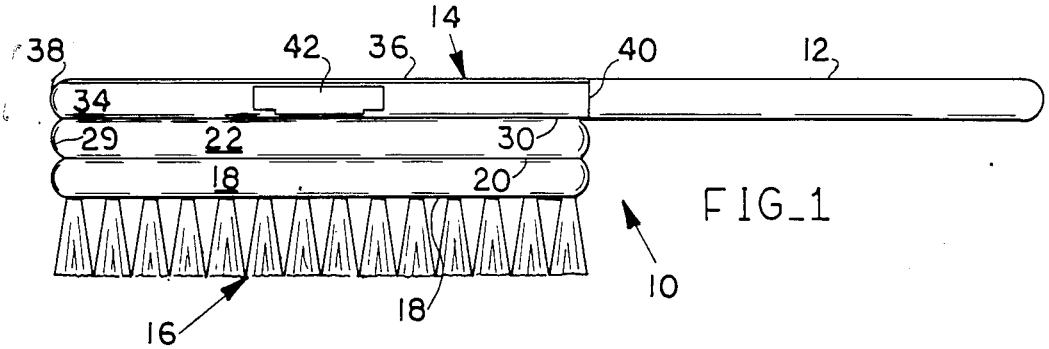
FIG. 1 is a side elevational view of a hair brush constructed in accordance with the teachings of this invention.

Referring now to FIG. 1, it will there be seen that a hair brush construction that illustrates the teachings of this invention is designated by the reference numeral 10 as a whole.

Hair brushes take many forms, of course; some have comb portions that are stored in a folded position until used, and so on. In view of the teachings and suggestions of the disclosure which follows, those skilled in the art of machine design will know how to construct any type of brush that embodies the present invention. Accordingly, all brush types that include the elements of the invention hereinafter set forth and claimed in the claims appended hereto are within the scope of this invention even though only one brush form is shown in the drawings; the illustrative brush is depicted simply because it is a typical brush construction and this invention is not restricted or defined by the drawings.

Brush 10 includes elongate handle 12 that extends longitudinally from base portion 14. A plurality of bristles, collectively designated 16, have their respective bases embedded in the bottom wall 18 of said base portion 14 and are accordingly firmly held thereby.

Top wall 20 of base portion 14 is imperforate and serves as the bottom wall of pill-discharging compartment 22 that is positioned upwardly of base 14 as depicted.

Upstanding, imperforate side walls 24, 26 (FIG. 4) define the longitudinal boundaries of pill-discharging chamber 22, and transversely disposed, upstanding, imperforate side wall 28 defines the only transverse boundary to said chamber 22. Accordingly, transverse boundary 29 of chamber 22 is open to the environment external to the brush so that a pill in chamber 22 may be retrieved therefrom when the brush is tilted, as best understood in connection with FIG. 3B.

Figure 2:
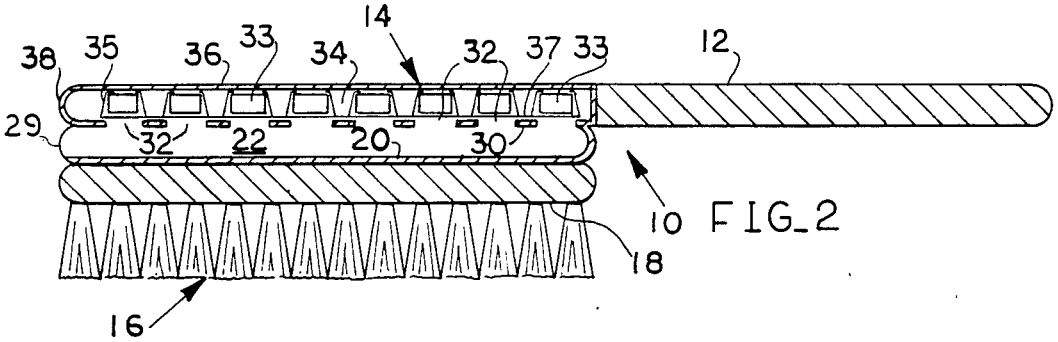
FIG. 2 is a longitudinal sectional view of the brush shown in FIG. 1.
Figure 3A:
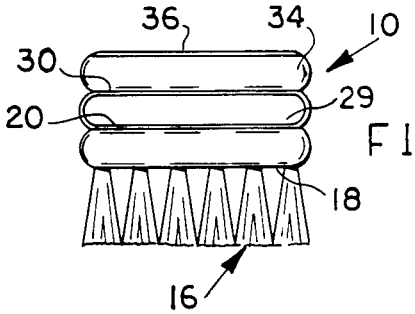
FIG. 3A is a front end view of the brush shown in FIG. 1.
Figure 3B:
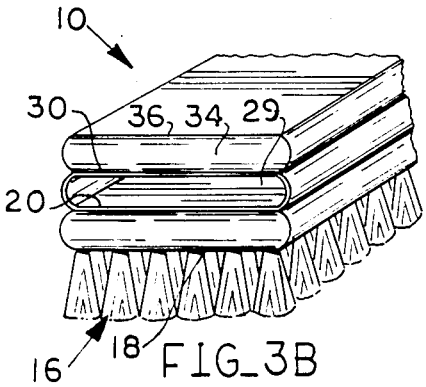
FIG. 3B is a partial perspective view showing the front end of the brush.

Top wall 30 of pill-discharging chamber 22 is provided with a matrix of apertures, collectively designated 32; said top wall 30 also serves as the bottom wall of pill storage compartment 34 which surmounts chamber 22 as shown in FIGS. 1, 2 and 3.

A three week supply of pills 33 is placed in storage compartment 34 every three weeks. The supply of pills, as shown in FIG. 2, is provided in a package of the type where each pill is individually packaged in a flexible bubble 35 and supported by a frangible support surface 37 that ruptures when the bubble is pressed. The bubbles 35 are shown discontinuous in the area over each pill although the pills are of course entirely encased within their associated bubble; it is believed FIG. 2 is more clear or less cluttered as drawn. For the same reason, the frangible support surface 37 is shown in FIG. 2 spaced slightly upwardly of wall 30 although of course frangible support means 37 actually rests thereatop and no such spacing exists.

Figure 4:
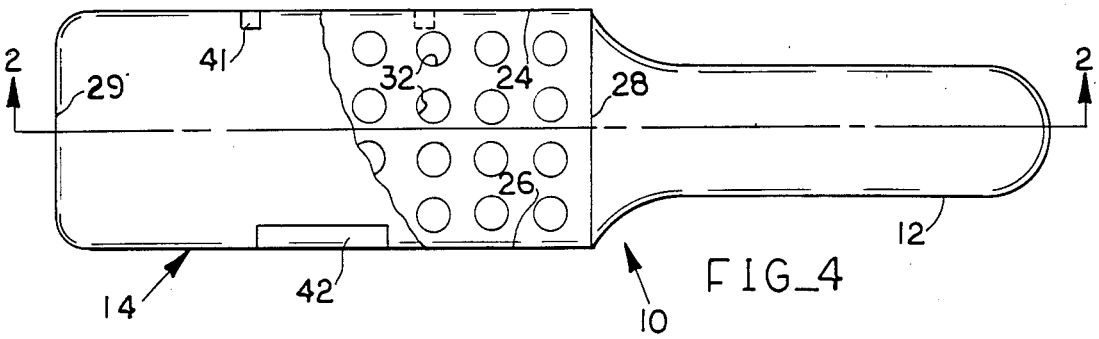
FIG. 4 is a top plan view of the brush shown in FIG. 1, partially broken away to show the arrangement of pills within the pill storage compartment.

The presence of the storage compartment 34 is masked by closure member 36 which may be hingedly mounted as shown in FIG. 4 or otherwise removably mounted. A mirror member could advantageously be mounted in overlying relation to lid 36.

Lid 36 has an imperforate, opaque end wall 38 (FIGS. 1 and 2) that retains the pill supply in compartment 34; its opaque quality is preferred so that the pills stored in such compartment will not be visible.

A parting line 40 (FIG. 1) separates lid 36 from handle 12 of the brush so that the lid opens independently of the handle, of course. Lid 36 is hingedly mounted as at 41 (FIG. 4).

Many locking means could be provided to retain lid 36 in its closed position; the illustrated means, denoted 42, is one of such means. It is a biased member that releases a latch (not shown) when depressed so that lid 36 may be opened. It is preferably recessed into lid 36 as shown in FIG. 4 so that it is as inconspicuous as possible and so that placing the brush in a purse or other container will not activate the unlocking mechanism inadvertently.

The only visually ascertainable indication that brush 10 is a pill dispenser is the presence of pill-discharging chamber 22 which has an open end as aforesaid. However, its depth, like that of pill storage chamber 34, is only slightly greater than the thickness of a pill; therefore, it is not particularly noticeable. Moreover, modern brush design is modular and many non-pill-containing brushes have open ends.

The act of brushing one's hair will cause the pills in storage compartment 34 to rattle as they impinge upon their respective bubbles, thus reminding the user of the brush of their presence.

Another advantage of the present construction resides in the fact that the dispensers of the prior art must be purchsed anew every three weeks; the pills are not sold separately. However, a manufacturer of pills, in view of the teaching of this invention, could now sell pills in re-fill form, i.e., independent of plastic dispensing devices. This would lower the cost of the pills to consumers and prevent unnecessary waste of plastic containers and the energy required to make them. Since brushes have long lives, the only time a new pill-dispensing case would need to be purchased would be when the brush itself manifests the effects of entropy.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A birth control pill dispenser, comprising:

a hair brush member having a solid base within which is mounted a plurality of bristle members;

a pill-discharging chamber surmounting said base;

said pill-discharging chamber having an open end for allowing pills disposed therein to exit therefrom;

said pill-discharging chamber having a top wall with a plurality of pill-sized openings formed therein;

a pill storage chamber surmounting said pill-discharging chamber;

said top wall of said pill-discharging chamber forming the bottom wall of said pill storage chamber;

a supply of birth control pills positioned in said pill storage chamber;

a frangible barrier means positioned in overlying relation to said bottom wall of said pill storage chamber;

said barrier means including a plurality of deformable pill-containing compartments, each of said compartments being positioned in registration with an associated pill-sized opening formed in said pill storage chamber bottom wall;

a pill positioned in each of said compartments;

and masking means operable to close said pill storage chamber so that when said pill storage chamber is closed, said pill dispenser has the appearance of a hair brush;

whereby a pill is dispensed from said dispenser by opening said masking means, pushing a preselected pill through its associated opening formed in said pill storage chamber bottom wall by deforming its compartment and breaking said frangible barrier means so that said pill falls through said opening into said pill-discharging chamber, and tilting said dispenser so that said pill slides out of said pill-discharging chamber through its open end.

2. The dispenser of claim 1, wherein said masking means is a hingedly mounted, imperforate closure member;

said closure member having the appearance of a hair brush base so that said pill dispenser has the appearance of a hair brush when said closure member is closed.

3. The dispenser of claim 1, wherein said bristle-mounting base, said pill-discharging chamber, said pill storage chamber and said masking means are generally parallelepiped in form and share a common length and width.

4. The dispenser of claim 3, wherein said pill-discharging chamber and said pill storage chamber have a substantially common depth, and wherein said depth is only slightly greater than the thickness of an individual pill.

5. The dispenser of claim 1, wherein said pill storage chamber is surrounded by upstanding, imperforate side walls.

6. The dispenser of claim 1, wherein said pill-discharging chamber is surrounded on three sides by upstanding, imperforate side walls, and wherein a fourth side thereof is in open communication with the environment external to said brush member;

said fourth side being said open end.

* * * * *